United States Patent [19]

Wentzell

[11] 4,405,452

[45] Sep. 20, 1983

[54] METHOD FOR SEPARATING PARTICULATE MATERIALS

[75] Inventor: J. Michael Wentzell, Remsen, N.Y.

[73] Assignee: United Technologies Corporation, Hartford, Conn.

[21] Appl. No.: 963,074

[22] Filed: Nov. 22, 1978

Related U.S. Application Data

[63] Continuation of Ser. No. 753,160, Dec. 21, 1976, abandoned.

[51] Int. Cl.[3] ..... B03B 5/44

[52] U.S. Cl. ..... 209/172; 209/11

[58] Field of Search ..... 209/1, 11, 172; 62/64

[56] References Cited

U.S. PATENT DOCUMENTS

| | | | |
|---|---|---|---|
| 2,109,234 | 2/1938 | Keenan | 209/172 X |
| 2,165,607 | 7/1939 | Blow | 209/172 |
| 2,730,235 | 1/1956 | Swimmer | 209/172 X |
| 2,896,922 | 7/1959 | Pohlman | 209/1 X |
| 3,133,876 | 5/1964 | Klass | 209/1 |
| 3,180,691 | 4/1965 | Wunsch et al. | 209/172 X |
| 3,578,162 | 5/1971 | Jepsen | 209/172 |
| 3,992,288 | 11/1976 | Kling | 209/172 |
| 3,997,435 | 12/1976 | Farnum et al. | 209/172 X |

OTHER PUBLICATIONS

O'Connell, "Properties of Heavy Liquids", Transactions of the Society of Mining Engineers, (pp. 126–132), Jun. 1963.

*Primary Examiner*—Ralph J. Hill
*Attorney, Agent, or Firm*—C. G. Nessler

[57] ABSTRACT

Particulate materials of different density are separated from one another by placing them in non-reactive liquefied gas of intermediate density whereby the lighter material floats and the heavier material sinks. A pressure field may be established in the liquefied gas to enhance the particulate separation process. The method is especially suited for separating and removing oxide and other particulate contaminants from metal and alloy powders.

3 Claims, 1 Drawing Figure

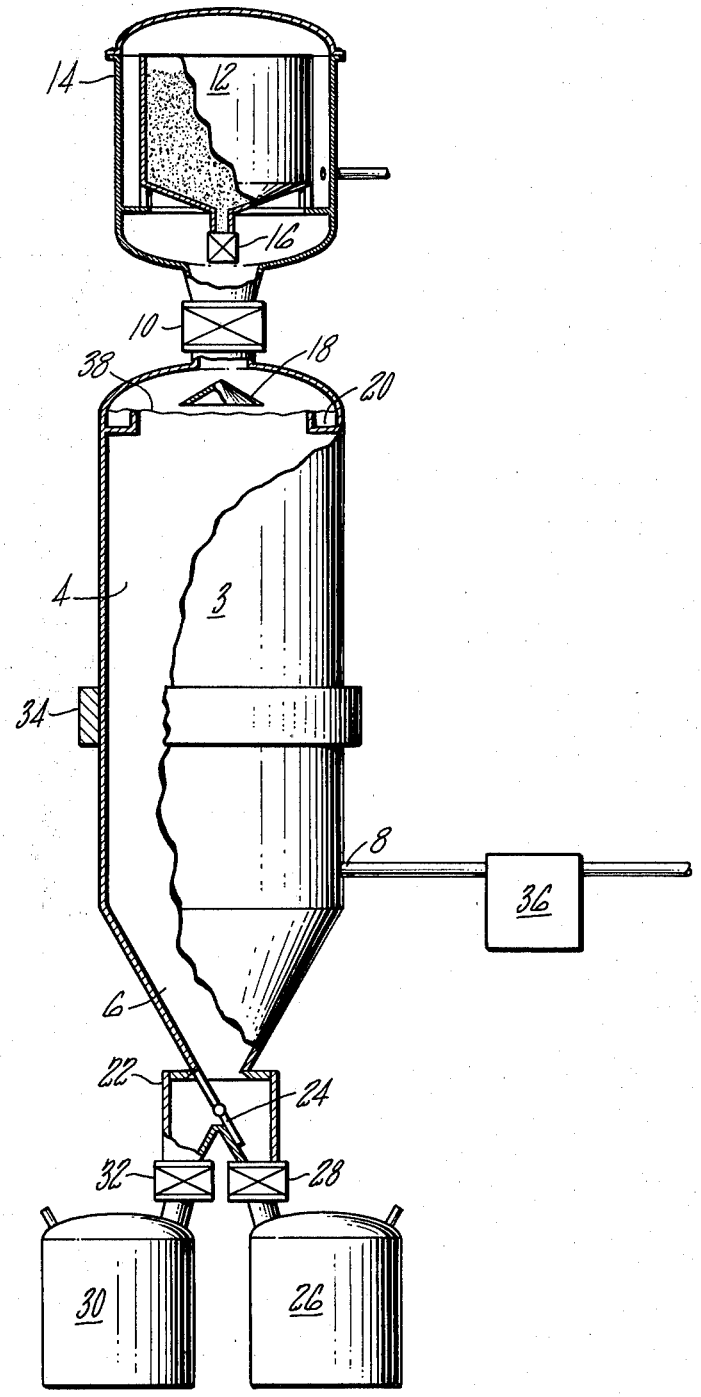
14
12
16
10
38
18
20
4
3
34
8
36
6
22
24
32
28
30
26

METHOD FOR SEPARATING PARTICULATE MATERIALS

This application is a continuation of application Ser. No. 753,160 filed Dec. 21, 1976, now abandoned.

BACKGROUND OF THE INVENTION

1. Field of the Invention

The present invention is directed to a method for separating particulate materials of different density.

2. Description of the Prior Art

In the manufacture of metal powder, contamination from crucibles and other molten metal handling equipment and from the melt stock itself is a frequent problem. Generally, contamination is in the form of oxide particulate, such as $SiO_2$, $Al_2O_3$ and others. These contaminants are deleterious in that they adversely affect the mechanical and other properties of articles made from such metal powder. The problem is especially severe when the metal powder article is to be subjected to conditions of high stress and temperature where premature failure cannot be tolerated, such as a metal powder disc used to hold turbine blades in proper alignment in a gas turbine or "jet" engine. In making such articles, only the highest purity metal powder should be used.

A process commonly employed to separate one particulate material from another of different density is the so-called "sink-float" process (hereafter referred to as floatation process) wherein the particulate materials are placed in a liquid separation medium having a density intermediate to the densities of the materials so that the lighter material floats and the heavier material sinks. However, in utilizing this process to separate contaminants from metal powder, difficulties are encountered. First, the separation medium must not only have the desired intermediate density but also must be nonreactive with the metal powder. If the metal powder reacts with the medium, the powder may be contaminated by reaction product. Of course, this defeats the purpose of the floatation process. Second, high density liquids, such as thallium malonate and thallium formate, are employed in such processes and leave a liquid residue on the separated metal powder. This residue must be removed by washing, heating and other means to provide a final powder product of optimum quality which is ready for use in powder metallurgy fabrication processes, such as compaction, forging and the like.

SUMMARY OF THE INVENTION

Accordingly, the present invention provides an improved floatation process for separating at least one particulate material from another of different density without contaminating the materials with reaction product and liquid residue from the separation medium. The invention is particularly useful for separating oxide particulate and other contaminants from metal powder.

An important feature of the invention is the utilization of a liquefied gas as the separation medium, the liquefied gas being substantially nonreactive with the particulate. In one embodiment, liquefied inert gas of intermediate density is contained within a vessel having a vertical chamber. Contaminated metal powder is introduced into the liquefied gas near the top of the chamber and the contaminant is separated from the metal powder as one floats and the other sinks depending upon their relative densities. For example, with $SiO_2$ contaminated nickel alloy powder in liquefied Xenon at −109° C., the $SiO_2$ particulate (density 2.3 gm/cc) will float while the heavier powder (density 7.9 gm/cc) sinks in the liquefied inert gas (density 3.5 gm/cc). The metal powder may be collected in the bottom of the vessel in a suitable collection chamber while the floating silica particulate may be removed with a skimmer device. When the separated powder is removed from the chamber to ambient conditions, the liquefied inert gas thereon vaporizes and thereby leaves no liquid residue on the powder. Of course, no reaction product is present on the powder since the liquefied gas is inert.

In another embodiment of the invention, a pressure field, counter current and the like may be generated in the liquefied gas which, in conjunction with separation forces due to density differences, effects particulate separation. This embodiment is especially useful when the density of the liquefied gas is sufficient to effect separation of some contaminants but not others. For example, if both $SiO_2$ and $Al_2O_3$ are present as contaminants in nickel alloy powder, liquefied Xenon at −190° C. can separate the $SiO_2$ particulate (density 2.3 gm/cc) but not the $Al_2O_3$ particulate (density 3.97 gm/cc) from the powder. However, if a standing pressure wave of sufficient magnitude to temporarily trap the $Al_2O_3$ particulate at the wave nodes but of insufficient magnitude to trap the much heavier metal powder is generated in the liquefied gas, both the $SiO_2$ and $Al_2O_3$ particulate contaminants can be separated and removed from the powder.

Of course, the procedure described in the above embodiments may be repeated as desired to insure removal of most, if not all, of the contaminants. In this way, ultra high purity metal or other powders may be obtained with the aid of the present invention.

These and other advantages and objects of the present invention will appear more fully from the following drawing and description of preferred embodiments.

BRIEF DESCRIPTION OF THE DRAWING

The FIGURE illustrates schematically a typical apparatus used in practicing the method of the invention.

DESCRIPTION OF PREFERRED EMBODIMENT

The present invention is described hereinbelow with reference to separating $SiO_2$ and $Al_2O_3$ particulate contaminants from nickel alloy powder. Of course, this particular description is offered merely for purposes of illustration and is in no way intended to limit the scope of the present invention.

Referring to the FIGURE, a typical apparatus useful in separating $SiO_2$ and $Al_2O_3$ particulate contaminants from nickel alloy powder, such as that generally known as IN100 having a nominal composition of 10% chromium, 15% cobalt, 4.5% titanium, 5.5% aluminum, 3% molybdenum, balance essentially nickel is shown. The apparatus includes a main vessel 3 having a cylindrical chamber 4 and conical chamber 6 therebelow. The cylindrical chamber is provided with gas inlet and outlet port 8 and metal powder entry interlock 10. Contaminated nickel alloy powder is introduced into chamber 4 through entry interlock 10 from a powder dispensing container 12 positioned within a smaller pressure vessel 14. The powder container includes a remotely-controlled valve 16 for releasing the desired amount of nickel powder. After passing through interlock 10, the powder is deflected from plate 18 into the liquefied gas. Contaminant gutter 20 functions to trap any floating particulate contaminant as explained below. The conical chamber functions to direct the descending cleaned nickel powder into housing 22 containing directional valve 24, the valve being positioned initially, as shown, to direct the cleaned nickel powder into powder receiving vessel 26 via powder exit interlock 28 and thereafter being positioned to direct falling $Al_2O_3$ particulate into contaminant receiving vessel 30 by way of interlock 32.

According to the method of the present invention, a liquefied gas which is nonreactive to the nickel alloy powder is utilized to separate the $SiO_2$ and $Al_2O_3$ particulate therefrom. Preferably, such a liquefied gas has a density intermediate those of $SiO_2$ and $Al_2O_3$ and that of the nickel powder so that the contaminants float while the powder sinks. However, this density relationship may not always be obtainable, as in the case of liquefied Xenon at −109° C. which has a density of 3.5 gm/cc as compared to 2.3 gm/cc for $SiO_2$, 3.97 gm/cc for $Al_2O_3$ and 7.9 gm/cc for IN100 nickel alloy powder. Evident from the density values is the fact that liquefied Xenon can separate $SiO_2$ particulate from the nickel powder as the $SiO_2$ floats and the nickel powder sinks therein. However, it is also evident that the Xenon alone cannot separate the $Al_2O_3$ particulate from the nickel powder since both will sink therein. In such a situation, the present invention calls for the generation of a pressure field, such as a standing pressure wave, in the liquefied Xenon of sufficient magnitude to temporarily trap the $Al_2O_3$ particulate at the wave nodes while the much heavier nickel alloy powder sinks. A suitable means for generating such a pressure field in the Xenon is an annular piezoelectric transducer 34 affixed circumferentially around the vessel, such as at the midlength thereof. When an alternating voltage is applied between the interior and the exterior surfaces of the transducer at its resonance frequency (or some fraction or multiple thereof), a roughly sinusoidal pressure field will be generated in the column of liquefied Xenon. That is, there will be alternating pressure and pressure gradient minima and maxima established in the Xenon, the strengths of which depend on applied voltage, damping effects in the field, height of the Xenon column and other factors. The actual field configuration is somewhat like a three-dimensional standing or moving rectified sinusoidal pressure wave. Under these conditions, the actual force on a particle in the Xenon is proportional to the local pressure multiplied by the pressure gradient and causes the particle to migrate toward specific locations on each node of the standing wave. The higher the voltage that is applied to the transducer, the closer the migration location is to the pressure maxima. The $Al_2O_3$ particulate, having a density closer to that of the Xenon than to that of the nickel powder, can be trapped by the pressure field at a specific voltage insufficient to trap the much heavier nickel powder which continues to fall through the liquefied Xenon. In this way, $Al_2O_3$ particulate in addition to $SiO_2$ particulate can be separated and removed from nickel powder with the aid of liquefied Xenon. Of course, those skilled in the art will recognize that other means, such as counter currents and the like, may also be used to temporarily trap the $Al_2O_3$ particulate. However, to effect separation by using counter currents, the particulate materials must be screened to narrow mesh ranges since particulate separation is dependent upon the density-area function in accordance with Stoke's law. Such screening is not required when using a standing or moving pressure wave.

The main vessel 3 of the FIGURE is supplied liquefied Xenon from storage unit 36 where the gas may be cooled below the critical temperature or pressurized above the critical pressure or both. The liquefied Xenon is pumped into the vessel through port 8 to a level 38 just slightly above the top of gutter 20 which extends around the circumference of chamber 4. A predetermined voltage is applied to the transducer 34, the voltage being sufficient to generate a standing pressure wave which will temporarily trap the $Al_2O_3$ particulate but not the nickel powder. Then, contaminated IN100 powder of less than 80 mesh and having about 2 ppm $SiO_2$ contaminant and about 1 ppm $Al_2O_3$ contaminant is introduced into the vessel from container 12 through valve 16 and entry interlock 10. Preferably, the contaminated powder is cooled to a similar temperature as the liquefied Xenon before being placed therein. As the powder falls, it strikes plate 18 which deflects the powder outwardly toward the chamber walls. As a result of the relative density relationship and the presence of the standing pressure wave, the $SiO_2$ particulate floats in the liquefied Xenon and is trapped in gutter 20 whereas the $Al_2O_3$ particulate begins to sink immediately but is temporarily trapped in the column of Xenon at the nodes of the pressure wave. Simultaneously, the nickel alloy powder sinks to the conical chamber where it is directed into receiving vessel 26 by valve 24. After all the nickel powder has been collected, the directional valve is repositioned and the voltage to the transducer discontinued to terminate the pressure wave in the Xenon. Thereupon, the $Al_2O_3$ particulate descends in the Xenon column into the conical chamber where it is directed by the repositioned valve 24 into receiving vessel 30. After interlocks 28 and 32 are closed and the liquid Xenon is removed by suitable means from vessels 26 and 30, the cleaned nickel alloy powder and $Al_2O_3$ particulate may be removed.

The separated and cleaned nickel powder obtained from receiving vessel 26 is not only free of $SiO_2$ and $Al_2O_3$ particulate but also is free of reaction product and liquid residue as a result of the inertness of the Xenon and its gaseous nature under ambient conditions of temperature and pressure. Any liquefied Xenon present on the powder rapidly volatizes when vessel 26 is opened to the atmosphere. The IN100 powder thus obtained is ready for immediate use in powder metallurgy fabrication processes without further treatment. Of course, if some $SiO_2$ and $Al_2O_3$ particulate is still associated with the cleaned powder, the process described hereinabove may be repeated until essentially all the contaminant is removed. In this way, ultra pure nickel or other metal and alloy powders may be obtained.

Those skilled in the art will recognize that other gases or mixtures thereof may be utilized in the method of the invention depending upon the materials being separated. Other suitable gases include, but are not limited to, nitrogen, neon, argon and krypton.

Of course, if only $SiO_2$ particulate is present with the nickel powder, there is no need for generation of a pressure field in the Xenon since the intermediate density of the Xenon is sufficient to effect the desired separation. It will be apparent to those skilled in the art that it may also be possible to use Xenon in the gaseous state to separate $SiO_2$ particulate from IN100; namely, by increasing the pressure on the gas until the desired intermediate gas density is achieved.

From the detailed description of the preferred embodiment, it is apparent that the present invention has wide applicability for cleaning metal and alloy powders of undesirable contamination. More generally, the invention may be used whenever it is desirable to separate at least one particulate material from another of different density without contaminating the materials in the process.

Although the invention has been shown and described with respect to illustrative embodiments thereof, it will be understood by those skilled in the art that other changes, omissions and additions in the form and detail thereof may be made without departing from the spirit and scope of the present invention.

Having thus described a typical embodiment of my invention, that which I claim as new and desire to secure by Letters Patent of the United States is:

1. In separating contaminant and oxide particulate materials of a density of about 2.3 gm/cc or greater from a particulate material which is metal of a density of about 8 gm/cc, the steps of:

(a) providing as a separation medium a substance which is a gas under ambient temperature and pressure, selected from the inert gas group consisting of nitrogen, neon, argon, krypton, or mixtures thereof, being substantially nonreactive in the liquid or gaseous state with said metal particulate;

(b) containing the separation medium in a pressure vessel and maintaining a pressure and temperature within the vessel which causes the separation medium to be a liquid;

(c) placing the particulate material in the medium within the pressure vessel to separate the particulates as the lighter materials float and the heavier materials sink therein;

(d) removing the separated particulate materials from the pressure vessel, (e) allowing any separation medium residue on the particulates to volatilize, the materials thereupon being clean and free of any residue or contamination as a result of the nonreactivity and gaseous nature of said medium.

2. The process in claim 1 wherein the separation medium has a specific gravity greater than 3.50.

3. The method of claim 1 wherein the metal powder is nickel alloy powder.

* * * * *